United States Patent [19]

Hayes et al.

[11] 4,121,634

[45] Oct. 24, 1978

[54] GLASS-SEALED VESSEL OPENING DEVICE AND METHOD

[75] Inventors: John Michael Hayes, Bloomington, Ind.; David John Des Marais, Menlo Park, Calif.

[73] Assignee: Indiana University Foundation, Bloomington, Ind.

[21] Appl. No.: 828,428

[22] Filed: Aug. 29, 1977

[51] Int. Cl.[2] ..... B65B 3/04

[52] U.S. Cl. ..... 141/98; 73/422 GC; 73/425.4 P; 222/541; 141/392

[58] Field of Search ..... 141/392, 65, 98; 222/3, 222/541; 73/422 GC, 425.4 P

[56] References Cited

U.S. PATENT DOCUMENTS

| | | | |
|---|---|---|---|
| 3,002,387 | 10/1961 | Micheletti | 73/422 GC |
| 3,475,127 | 10/1969 | Gilford | 73/425.4 P |

*Primary Examiner*—Houston S. Bell, Jr.
*Attorney, Agent, or Firm*—Kirkland & Ellis

[57] ABSTRACT

A device for opening glass-sealed vessels in order either to recover a gas from or to introduce a gas into a vacuum system or other confined atmosphere comprises first vessel receiving means adapted removably to receive therein a projecting end of the glass-sealed vessel along with second vessel receiving means similarly adapted removably to receive therein the projecting end of the glass-sealed vessel, with the proximal ends of the first and second vessel receiving means being positioned adjacent each other. A flexible tubing means adapted removably to receive the proximal ends of the first and second vessel receiving means therein is provided along with first coupling means for effecting a vacuum tight seal between the flexible tubing means and a confined atmosphere and second coupling means for effecting a vacuum tight seal between the flexible tubing means and the glass-sealed vessel, whereby flexure of glass-sealed vessel, second coupling means and second vessel receiving means as a unit permits the projecting end of the glass-sealed vessel to be ruptured adjacent the proximal ends of the first and second vessel receiving means thereby to release the contents of the glass-sealed vessel into the confined atmosphere.

5 Claims, 3 Drawing Figures

GLASS-SEALED VESSEL OPENING DEVICE AND METHOD

BACKGROUND OF THE INVENTION

1. Field of the Invention

This invention involves the introduction of gases or volatile liquids to and removal thereof from a confined atmosphere, and more particularly relates to a device for opening glass-sealed vessels in a confined atmosphere in order to recover the gas or volatile liquid contained therein.

2. Description of the Prior Art

The necessity for recovering gases and volatile liquids from a confined atmosphere or introducing gases and volatile liquids into a confined atmosphere is encountered in many areas of science. The conventional method for accomplishing this involves the use of a glass-sealed vessel fitted with a glass breakseal.

A glass breakseal consists of a length of glass tubing drawn out at one end to form a thin capillary tube. The narrow capillary part is bent and sealed at its end in order to form a fragile closure which can be easily broken when some object strikes the tip. A complete breakseal is formed by placing a straight piece of glass tubing over the drawn out sealed tip and then sealing it to the shoulders of drawn tube. The glass breakseal is attached along with an open glass tube to a glass vessel which will receive the gas or volatile liquid.

In order to recover a gas from a confined atmosphere, the open tube of the vessel is attached to the confined atmosphere. The vessel is then evacuated and filled with the gas, usually by employing a cryogenic fluid to trap the gas in the vessel. With the cryogenic fluid still in place, a glass blow torch is used to seal the open tube, and the vessel is removed from the confined atmosphere with the gas thus being contained and sealed in an all glass leakproof vessel.

When the contained gas is to be introduced into a confined atmosphere, a small metal slug or other movable weight is placed in the tube containing the breakseal, and the tube containing the breakseal is then connected to the confined atmosphere. A magnet is used to raise a metal weight, which is then allowed to drop and fracture the glass breakseal, thus releasing the gas from the vessel to the confined atmosphere. Alternatively, when using a non-metallic weight, the glass-sealed vessel may be either shaken or inverted to cause the weight to break the glass breakseal.

Breakseals may find application wherever gases or volatile liquids are handled. Typically, they are utilized to recover gases from vacuum systems or to introduce gases into vacuum systems. Also, they are utilized to remove gases from an experimental apparatus for introduction into another experimental or analytical apparatus.

The use of breakseals has several disadvantages. First, although breakseals can be made using pure quartz tubing, the properties of quartz are such that it is frequently very difficult to break the seal no matter how thin the wall of the seal might be. Second, breakseals are either time consuming to fabricate or extremely expensive to purchase since they are made entirely by hand labor. Finally, any vessel which contains a breakseal is fragile and prone to leakage.

Thus, it would be a decided improvement over the prior art to have a device which could be employed to open a standard piece of glass tubing which has been conventionally heat sealed at its end and thereby eliminate the need to attach a breakseal to the tubing. Such a device would permit the utilization of glass-sealed vessels that are sturdy, inexpensive and versatile. In addition, this would allow gas filled ampoules, consisting of standard glass tubing conventionally sealed at both ends, to be opened. Furthermore, a glass-sealed vessel of any shape, to which a single glass tube has been attached, could be opened by utilizing such a device to open the attached tube.

Accordingly, a primary object of this invention is to provide a practical device for opening glass-sealed vessels in a confined atmosphere.

Another object is to provide a device of the character described which may be employed to open a glass tube which has been conventionally sealed thereby eliminating the need to use a breakseal.

A further object is to provide a device of the character described which may be employed to open a vessel which comprises standard glass tubing which is conventionally sealed at each end.

A still further object is to provide a device of the character described which may be employed to open a vessel of any shape to which a length of glass tubing has been attached.

A related object is to provide a device of the character described which may be employed to open tubes made of pure quartz.

SUMMARY OF THE INVENTION

The foregoing and other objects, advantages and features of the present invention may be achieved with a glass-sealed vessel opening device comprising first vessel receiving means communicating with a confined space and adapted removably to receive therein a projecting end of the glass-sealed vessel; second vessel receiving means adapted removably to receive therein the projecting end of the glass-sealed vessel, the proximal ends of the first and second vessel receiving means being positioned adjacent each other; flexible tubing means adapted removably to receive the proximal ends of the first and second vessel receiving means therein; first sealing means for effecting a vacuum tight seal between the flexible tubing means and a confined space; and second sealing means for effecting a vacuum tight seal between the flexible tubing means and the glass-sealed vessel; whereby, flexure of the glass-sealed vessel, second sealing means and second vessel receiving means as a unit permits the projecting end of the glass-sealed vessel to be ruptured adjacent the proximal ends of the first and second vessel receiving means thereby to release the contents of the glass-sealed vessel into the confined space.

In use, the first vessel receiving means and flexible tubing means remain attached to the confined atmosphere system. The second sealing means and second vessel receiving means are removed from the flexible tubing means by loosening the second sealing means. The glass-sealed vessel to be opened is scored about 1 centimeter from its sealed end using a file or tungsten carbide blade. The second vessel receiving means is firmly seated in the second sealing means, then the glass-sealed vessel is inserted through the second sealing means and into the second vessel receiving means until the sealed end emerges from the proximal end of the second vessel receiving means and the filed notch is aligned with the proximal end of the second vessel receiving means. The glass-sealed vessel is then secured to the second sealing means, the glass-sealed vessel is inserted through the flexible tubing means into the first vessel receiving means, and the second sealing means is secured to the flexible tubing means. The glass-sealed vessel is opened by flexing the lower end of the glass-sealed vessel until the vessel cracks.

After the transfer of the gas sample is completed, the second sealing means and second vessel receiving means are removed by loosening the second sealing means. The expended glass-sealed vessel is then removed by loosening the second coupling means and discarded.

Accordingly, the device of this invention provides a practical device for opening glass-sealed vessels in a confined atmosphere.

DETAILED DESCRIPTION OF THE PREFERRED EMBODIMENTS

In accordance with the present invention, a device is obtained which allows glass-sealed vessels to be opened in a confined atmosphere in order to recover the gas or volatile liquid contained therein.

Figure 1:
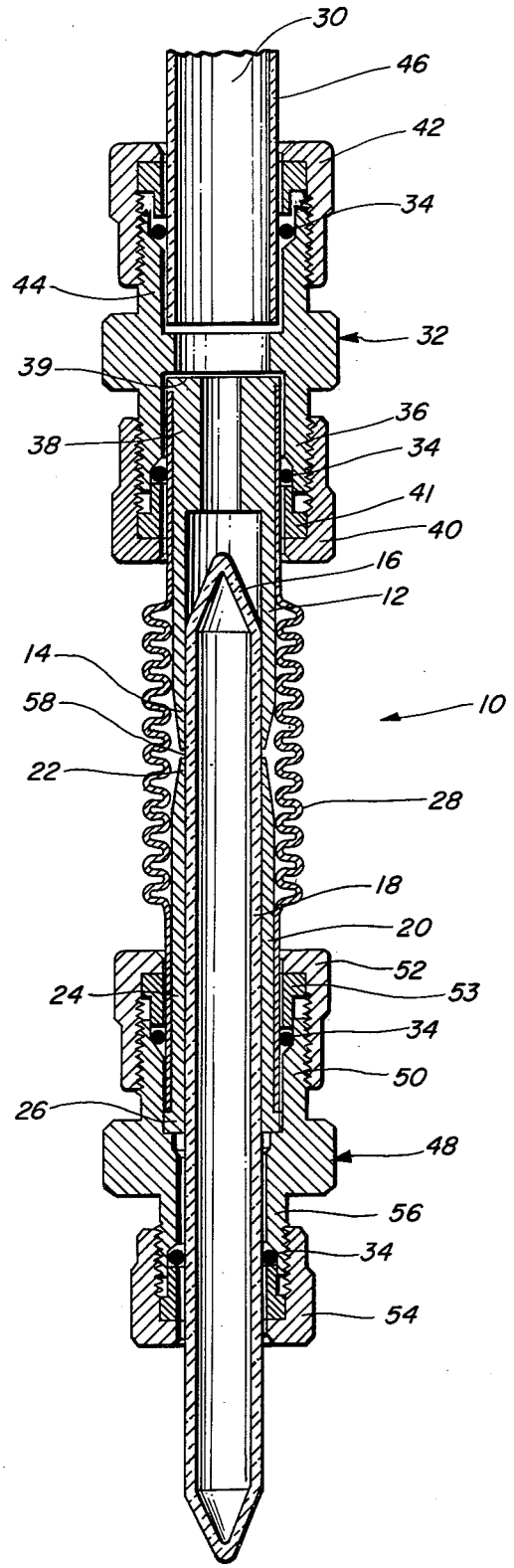
FIG. 1 is a sectional view of a glass-sealed vessel opening device in accordance with this invention.

Referring to FIG. 1, there is shown a glass-sealed vessel opening device 10. The device includes a first vessel receiver 12 having a proximal end 14 that is adapted to fit removably over the sealed end 16 of a glass-sealed vessel 18. The device also includes a second vessel receiver 20 having a proximal end 22 that is adapted to removably fit over the glass-sealed vessel 18. The distal ends 38, 24 of the vessel receivers 12, 20 have exterior lips 39, 26 of larger diameter than the body for a purpose that will hereinafter be described.

Substantially, any suitable material may be employed in fabricating the first and second vessel receivers 12, 20 but stainless steel has been found to be especially satisfactory.

A flexible tubing 28 is adapted removably to receive the first vessel receiver 12 and second vessel receiver 20. When the glass-sealed vessel opening device 10 is assembled, the flexible tubing 28 longitudinally encloses the first vessel receiver 12 and longitudinally encloses the second vessel receiver 20 with its ends abutting lips 26 and 39.

The proximal end 14 of the first vessel receiver 12 and the proximal end 22 of the second vessel receiver 20 may be tapered as shown in the drawing to prevent the vessel receivers 12, 20 from binding against each other during the flexing operation. Furthermore this facilitates insertion of the receivers 12, 20 into the flexible tubing 28.

Substantially, any suitable material may be employed for the flexible tubing 28, but flexible stainless steel tubing has been found to be especially satisfactory.

First sealing means to connect the flexible tubing 28 and the first vessel receiver 12 to a confined atmosphere system 30 comprises a union connection 32 containing O-ring seals 34. The proximal end 36 of the union 32 is secured to the distal end 38 of the first vessel receiver 12 and the flexible tubing 28 by rotationally tightening a fitting 40 to force the sleeve 41 to compress the O-ring 34 and force the flexible tubing 28 securely against the distal end 38 of the first vessel receiver 12 thereby effecting a vacuum tight seal.

In the same manner, a fitting 42 is tightened to secure the distal end 44 of the union 32 to a tube 46 which is connected to the confined atmosphere 30.

Substantially any suitable first sealing means may be employed, but a stainless steel vacuum union containing Viton O-rings has been found to be especially satisfactory.

Second sealing means to connect the glass-sealed vessel 18 to the flexible tubing 28 and second vessel receiver 20 comprises a reducing union connection 48 containing O-ring seals 34. The proximal end of 50 of the reducing union 48 is secured to the flexible tubing 28 and the distal end 24 of the second vessel receiver by rotationally tightening a fitting 52 to force the sleeve 53 to compress the O-ring 34 and force the flexible tubing 28 securely against the distal end 24 of the second vessel receiver 20 thereby effecting the vacuum tight seal.

In the same manner a fitting 54 is tightened to secure the distal end 56 of the reducing union 48 to the glass-sealed vessel 18.

Substantially, any suitable second coupling means may be employed but a stainless steel vacuum reducing union containing Viton O-rings has been found to be especially satisfactory.

In use, the union 32, first vessel receiver 12, and the flexible tubing 28 remain attached to the vacuum system 30. The reducing union connection 48 and second vessel receiver 20 are removed by loosening the proximal fitting 52 of the reducing union 48 to facilitate proper insertion of the glass-sealed vessel 18. The fitting 52 is loosened only partly such that when the reducing union 48 is removed from the flexible tubing 28, the O-ring 34 catches the exterior lip 26, which has a diameter slightly larger than the flexible tubing 28, withdrawing it from the flexible tubing 28. Likewise to facilitate removal of the first vessel receiver 12, the fitting 40 of the union 32 is loosened only partly such that when the union 32 is removed from the flexible tubing 28 the O-ring 34 catches the exterior lip 39.

The glass-sealed vessel 18 is scored approximately 1 centimeter from its sealed end 16 using a file or glass knife. The distal end 24 of second vessel receiver 20 is firmly seated in the reducing union 48, and the glass-sealed vessel 18 is inserted into the distal fitting 54 of the reducing union 48 until the sealed end 16 emerges from the proximal end 22 of the second vessel receiver 20. The filed notch 58 is aligned with the proximal end 22 of the second vessel receiver 20. It is also helpful to align the notch 58 rotationally with a mark scribed on the exterior surface of the reducing union 48. This facilitates identification of the side of the glass-sealed tube 18 that has been scored when the device is assembled and evacuated. The distal fitting 54 of the reducing union 48 is then tightened onto the glass-sealed vessel 18, and the proximal fitting 52 of the reducing union 48 is slipped onto the flexible tubing 18 and tightened. The confined space 30 is then evacuated, and the vacuum system is prepared to accept the gas sample. The glass-sealed vessel 18 is cracked open by flexing the fitting 48, second vessel receiver 20, and flexible tubing 28 away from the notch 58 on the glass-sealed vessel 18, and its contents safely passes into space 30.

After the transfer of the gas sample is completed, the reducing union 48 and the second vessel receiver 20 are removed by loosening the proximal fitting 52. The expended glass-sealed tube 18 is then removed by loosening the distal fitting 54 of the reducing union 48 and discarded.

Figure 2:
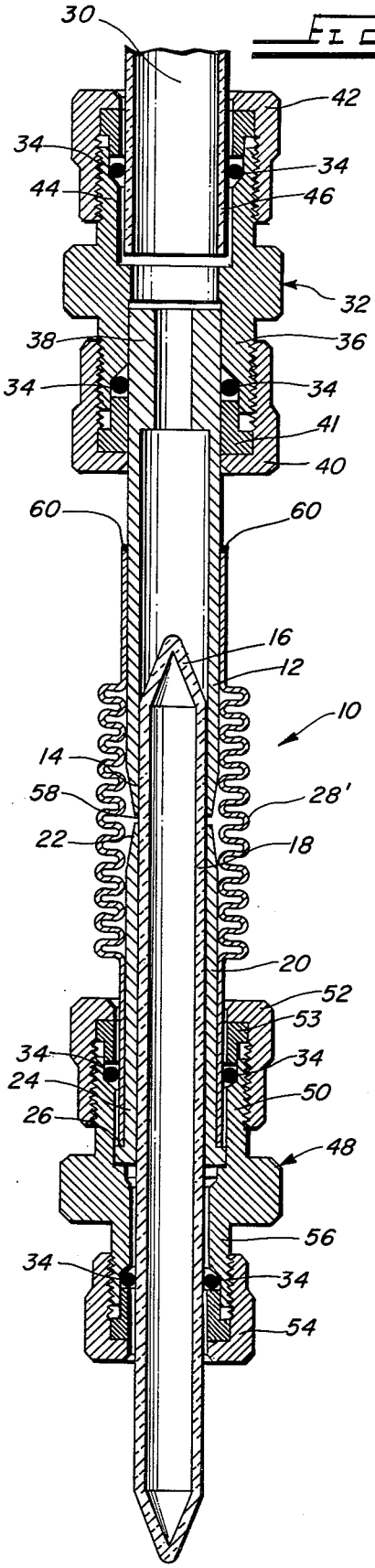
FIG. 2 is a sectional view of another embodiment of this invention.

An alternative structure is shown in FIG. 2. The flexible tubing 28' is permanently secured by a vacuum tight joint to first vessel receiver 12 as shown at 60, as by welding, soldering, brazing or the like. Thus, the flexible tubing 28' need not extend within the union connection 32, which receives only the first vessel receiver 12.

Figure 3:
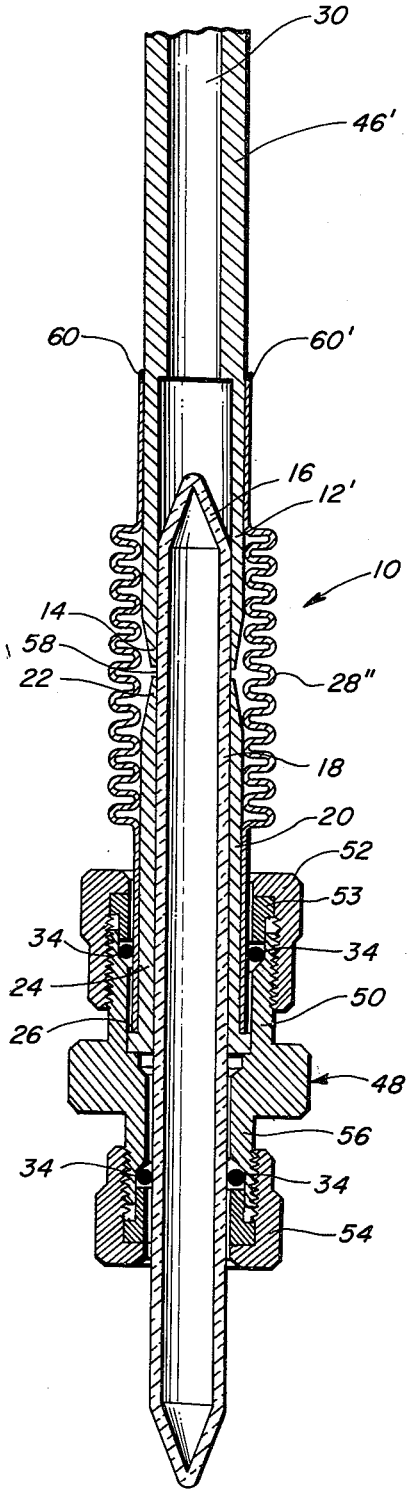
FIG. 3 is a sectional view of a third embodiment thereof.

Another alternative embodiment is shown in FIG. 3. Union connection 32, as shown in the embodiments shown in FIGS. 1 and 2, is not employed, and instead vessel receiver 12' is an integral extension of tube 46' connected to confined atmosphere 30. Flexible tubing 28'' secured to vessel receiver 12' by a vacuum tight joint by a welding, brazing, or soldering as shown at 60'.

The embodiments shown in FIGS. 2 and 3 function identically to the version shown in FIG. 1 once the glass sealed vessel 18 is positioned and the reducing union 48 secured in place.

The device of this invention thus fulfills a significant role in overcoming the disadvantages of prior art efforts utilizing breakseals. In particular, it provides a practical device for opening glass-sealed vessels in a confined atmosphere.

Moreover, the device of this invention may be employed to open a glass tube which has been conventionally sealed and thereby eliminates the need to use a breakseal. Therefore, the device of this invention may be employed to open a glass-sealed vessel which comprises standard glass tubing which has been conventionally sealed at each end. Furthermore, the device of this invention may be employed to open a vessel of any shape to which a length of glass tubing has been attached.

At the same time, by eliminating the need to utilize breakseals, the device of this invention allows vessels to be used which are more compact, durable, leak free, versatile and inexpensive. In addition, the device of this invention is easier and less time consuming to use. Finally, the device of this invention is a more practical method for opening vessels made of pure quartz.

We claim:

1. A device for opening glass-sealed vessels comprising:

means defining a confined space;

first vessel receiving means communicating with the confined space and adapted removably to receive therein a projecting end of the glass-sealed vessel;

second vessel receiving means adapted removably to receive therein the projecting end of the glass-sealed vessel, the proximal ends of the first and second vessel receiving means being spaced from and positioned adjacent each other;

flexible tubing means adapted removably to receive the proximal ends of the first and second vessel receiving means therein;

first sealing means for effecting a vacuum tight seal between the flexible tubing means and the confined space; and second sealing means for effecting a vacuum tight seal between the flexible tubing means and the glass-sealed vessel;

whereby application of a flexing force to the glass-sealed vessel, second sealing means and second vessel receiving means as a unit permits the projecting end of the glass-sealed vessel to be ruptured adjacent the proximal ends of the first and second vessel receiving means thereby to release the contents of the glass-sealed vessel into the confined space.

2. A device, as claimed in claim 1, wherein the first sealing means comprises a first union connection adapted sealingly to connect the distal end of the flexible tubing means, with the first vessel receiving means positioned therein, and tube means communicating with the confined space, the first union connection including first means for effecting a vacuum tight seal between the union connection and the flexible tubing means and second sealing means for effecting a vacuum tight seal between the union connection and the tube means.

3. A device, as claimed in claim 1, wherein the first sealing means comprises:

a vacuum tight joint between the first vessel receiving means and the flexible tubing means; and coupling means for effecting a vacuum tight seal between the confined space and the first vessel receiving means.

4. A device, as claimed in claim 1, wherein the first vessel receiving means is integrally connected to the confined space and the first sealing means comprises a vacuum tight joint between the first vessel receiving means and the flexible tubing means.

5. A device, as claimed in claim 1, wherein the second sealing means comprises a union connection adapted sealingly to connect the proximal end of the flexible tubing means, with the second vessel receiving means positioned therein, and a glass-sealed vessel, the second union connection including first means for effecting a vacuum tight seal between the union connection and the flexible tubing means and second means for effecting a vacuum tight seal between the union connection and the glass-sealed vessel.

* * * * *